US007953364B2

(12) United States Patent
Park

(10) Patent No.: US 7,953,364 B2
(45) Date of Patent: May 31, 2011

(54) DEVICE FOR DISPLAYING DIGITAL BROADCASTING CHANNEL AND METHOD THEREOF

(75) Inventor: Jae Wan Park, Gumi-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 563 days.

(21) Appl. No.: 12/129,084

(22) Filed: May 29, 2008

(65) Prior Publication Data

US 2008/0299893 A1 Dec. 4, 2008

(30) Foreign Application Priority Data

May 31, 2007 (KR) ..... 10-2007-0053184

(51) Int. Cl.
*H04H 40/18* (2008.01)

(52) U.S. Cl. ..... 455/3.06; 455/566; 455/435.3; 455/512; 455/556.1; 455/185.1

(58) Field of Classification Search ..... 455/3.03, 455/3.06, 412.1, 410, 414.1, 420, 425, 435.3, 455/512, 552.1, 556.1, 566, 185.1, 186.1, 455/456.3; 345/173, 520; 348/14.04; 725/40, 725/56, 50, 117, 112, 113, 139
See application file for complete search history.

(56) References Cited

U.S. PATENT DOCUMENTS

| | | | | |
|---|---|---|---|---|
| 2005/0102705 | A1* | 5/2005 | Karczewska | 725/132 |
| 2005/0165918 | A1* | 7/2005 | Wantanabe et al. | 709/223 |
| 2006/0135139 | A1* | 6/2006 | Cheng et al. | 455/418 |
| 2007/0126877 | A1* | 6/2007 | Yang | 348/207.99 |
| 2007/0136669 | A1* | 6/2007 | Kwon et al. | 715/721 |
| 2008/0051033 | A1* | 2/2008 | Hymes | 455/47 |
| 2008/0057941 | A1* | 3/2008 | Scott et al. | 455/425 |
| 2008/0248787 | A1* | 10/2008 | Hwang et al. | 455/414.3 |

FOREIGN PATENT DOCUMENTS

KR 1020050123320 12/2005

OTHER PUBLICATIONS

Korean Intellectual Property Office, Preliminary Rejection Notice dated Sep. 23, 2009.

* cited by examiner

*Primary Examiner* — Tan Trinh
(74) *Attorney, Agent, or Firm* — H.C. Park & Associates, PLC

(57) ABSTRACT

A device for displaying a broadcasting channel set individually by users and a method thereof are disclosed. The method includes entering a broadcasting reception mode, extracting a facial image from an image input through a camera, searching for an image corresponding to the extracted facial image from at least one image stored in a memory unit, and displaying a broadcasting channel corresponding to the extracted facial image.

17 Claims, 3 Drawing Sheets

DEVICE FOR DISPLAYING DIGITAL BROADCASTING CHANNEL AND METHOD THEREOF

CROSS REFERENCE TO RELATED APPLICATION

This application claims priority from and the benefit of Korean Patent Application No. 2007-0053184, filed on May 31, 2007, which is hereby incorporated by reference for all purposes as if fully set forth herein.

BACKGROUND OF THE INVENTION

1. Field of the Invention

The present invention relates to a device for displaying a broadcasting channel and a method thereof, and more particularly, to a device for displaying a broadcasting channel according to individual users and a method thereof.

2. Description of the Related Art

Modern mobile terminals may be equipped with a dedicated multimedia processor and they may have various multimedia functions. In particular, it is becoming increasingly popular to install digital broadcasting receivers in mobile terminals. Thus, modern mobile terminals may be configured to provide services of various multimedia functions. However, the mobile terminal's configuration and a method of processing in the mobile terminal become more complex to satisfy these requirements.

Generally, when a broadcasting reception function is selected in a mobile terminal having a digital broadcasting receiver, the channel that is initially displayed is the most recently viewed channel among various channels or a broadcasting channel set by a user. However, two or more people may share a single mobile terminal. In this case, different channels may be set according to each user, which may inconvenience a user because the user may have to input information so that the mobile terminal will display the channel set by that user.

SUMMARY OF THE INVENTION

The present invention provides a mobile terminal and a method for displaying a broadcasting channel according to individual users when users set different favorite channels.

The present invention further provides a mobile terminal and a method for selectively displaying a broadcasting channel when two or more users share a mobile terminal to watch broadcasting programs.

The present invention further provides a mobile terminal and a method for controlling a display of a broadcasting channel when a user wants to watch a broadcasting program on a mobile terminal while another user is watching another broadcasting program on the same mobile terminal.

Additional features of the invention will be set forth in the description which follows, and in part will be apparent from the description, or may be learned by practice of the invention.

The present invention discloses a method of displaying broadcasting channel in a mobile terminal. The method includes entering a broadcasting reception mode, extracting a facial image from an image input through a camera, searching for a corresponding image to the extracted facial image from at least one image stored in a memory unit, and displaying a broadcasting channel that corresponds to the corresponding image.

The present invention also discloses a mobile terminal including a camera, a memory unit to store at least one image, and a control unit. In a broadcasting reception mode, the control unit extracts a facial image from an image input through the camera, searches for a corresponding image to the extracted facial image from at least one image stored in the memory unit, and displays a broadcasting channel that corresponds to the corresponding image.

The present invention also discloses another method of displaying a broadcasting channel in a mobile terminal. This method includes entering a broadcasting reception mode, receiving a signal including a first facial image from a camera, detecting a first user of the mobile terminal by recognizing the first facial image, and displaying a first broadcasting channel that corresponds to the first user.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
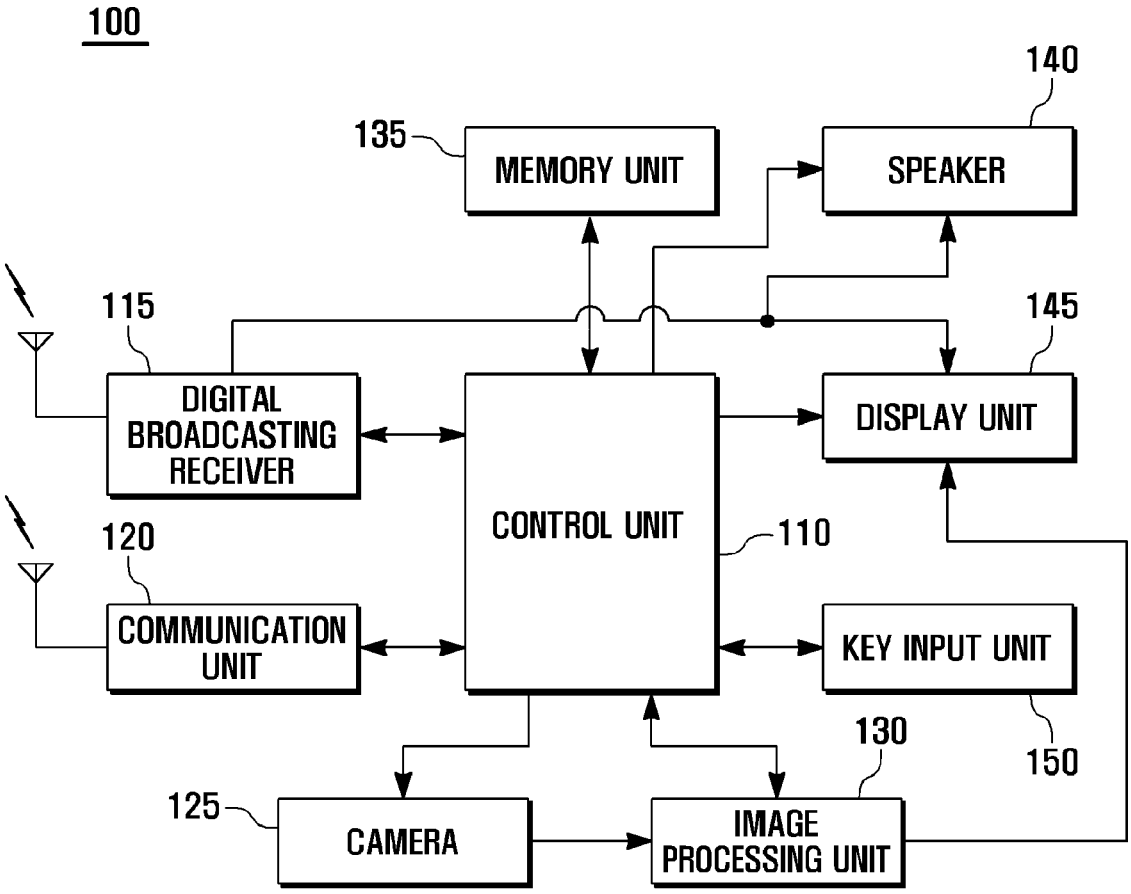
FIG. 1 is a block diagram showing a configuration of a mobile terminal for displaying a broadcasting channel according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

FIG. 1 is a block diagram showing a configuration of a mobile terminal 100 for displaying a broadcasting channel according to an exemplary embodiment of the present invention.

Referring to FIG. 1, the mobile terminal 100 includes a control unit 110, digital broadcasting receiver 115, communication unit 120, image processing unit 130, memory unit 135, speaker 140, display unit 145, and key input unit 150. The control unit 110 controls the general operations of the mobile terminal 100. The key input unit 150 outputs a key signal input by a user to the control unit 110. A user command generated through the key input unit 150 may be a key signal for controlling a digital broadcasting function of the mobile terminal 100. The control unit 110 may include a data processing unit having a codec (coder & decoder) for encoding a signal to be transmitted and for decoding a received signal and a modem (modulator & demodulator) for modulating the encoded transmission signal and for demodulating the received signal. The data processing unit may be separated from the control unit 110 and installed between the communication unit 120 and the control unit 110. The operation of the control unit 110 is described in detail below.

The memory unit 135 may include a program memory for storing programs for controlling the digital broadcasting receiver 115, and a data memory for storing broadcasting channels set by individual users and data generated during the operation of the programs.

The communication unit 120 performs a communication function of the mobile terminal 100 for transmitting and receiving a signal. The communication unit 120 may include a frequency converter for up-converting the frequency of a signal to be transmitted and down-converting the frequency of a received signal, and a duplexor for separating signals received, or to be transmitted through, an antenna.

The digital broadcasting receiver 115 outputs a signal by selectively modulating and demodulating a broadcasting signal received under the control of the control unit 110. The digital broadcasting receiver 115 may include a tuner, modulator, and demodulator. The digital broadcasting receiver 115 may be a Digital Multimedia Broadcasting (DMB) receiver or a Digital Video Broadcasting (DVB) receiver. The DMB receiver may be a ground wave receiver or a satellite receiver, and the DVB receiver may be a DVB-Terrestrial (DVB-T) receiver or a DVB-Handheld (DVB-H) receiver.

The speaker 140 and display unit 145 output a broadcasting signal received through the digital broadcasting receiver 115 and data generated by the control unit 110.

The camera 125 generates an image signal by taking a picture. The camera 125 includes a sensor for converting an optical signal to an electrical signal, and a signal processing unit for converting the electrical signal output by the sensor to a digital signal. The camera 125 takes a picture including an image of a person according to an exemplary embodiment of the present invention. The camera 125 may take a single picture or it may provide a video signal.

The image processing unit 130 generates screen data for displaying an image signal output by the camera 125. The image processing unit 130 includes an image codec, and it compresses image data to be displayed in the display unit 145 in a predetermined method or decompresses the compressed image data to its original state.

If the mobile terminal 100 enters a broadcasting reception mode, the control unit 110 receives an image from the camera 125. The control unit 110 extracts a facial image from the received image and compares it with an image stored in the memory unit 135. If an image identical or similar to the extracted facial image is stored in the memory unit 135, the control unit 110 controls the digital broadcasting receiver 115 to connect to a broadcasting channel corresponding to the image. The image received from the camera 125 may be a single picture or a video image. In other words, the camera 125 may automatically take a snap-shot when the mobile terminal 100 enters the broadcasting reception mode, or it may alternatively provide a video signal while the mobile terminal 100 remains in the broadcasting reception mode. If the camera 125 provides a video signal while the mobile terminal 100 remains in the broadcasting reception mode, the mobile terminal 100 may automatically update display of channels according to the users captured by the video, which is more convenient to the users. On the other hand, in order to conserve power, the camera 125 may be set to take a single picture when the mobile terminal 100 enters the broadcasting reception mode and also in response to user input.

Figure 2:
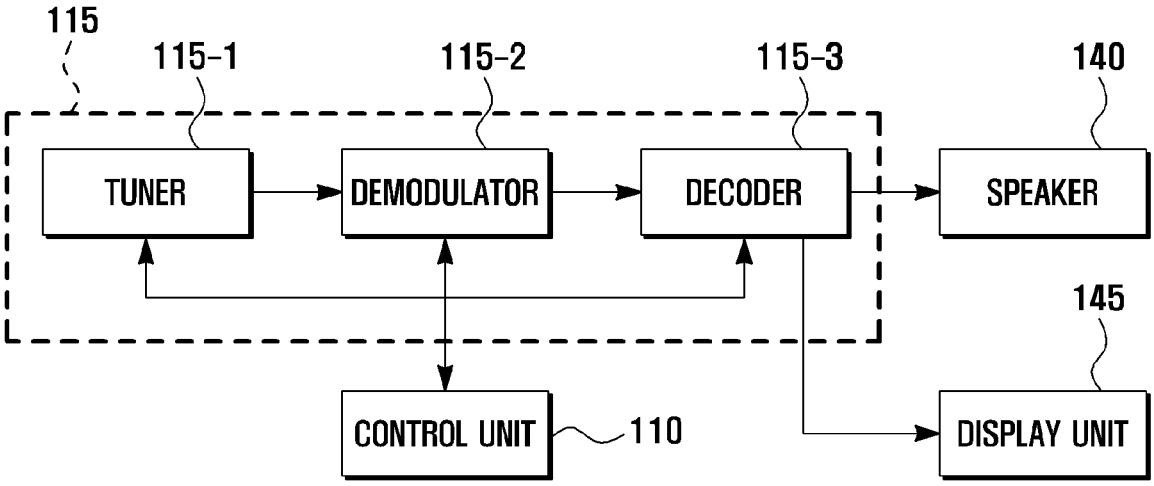
FIG. 2 is a block diagram showing a detailed configuration of a digital broadcasting receiver of FIG. 1.

FIG. 2 is a block diagram showing a detailed configuration of the digital broadcasting receiver 115 of FIG. 1.

Referring to FIG. 2, the digital broadcasting receiver 115 is controlled by the control unit 110, and includes a tuner 115-1 for receiving a broadcasting signal by synchronizing with the frequency of a channel selected by the user, a demodulator 115-2 for demodulating the received broadcasting signal of the selected channel frequency, and a decoder 115-3 for separating audio, video, and broadcasting data signals from the demodulated broadcasting signal, and individually decoding the separated signals. The decoder 115-3 may include a device for separating the signals and a plurality of decoders, such as an audio decoder and a video decoder.

When displaying a digital broadcasting channel, the control unit 110 sets a frequency for receiving a broadcasting signal, according to a broadcasting channel selected by the user, through the tuner 115-1. The tuner 115-1 receives the broadcasting signal by synchronizing with the frequency set to the selected broadcasting channel. The demodulator 115-2 demodulates the received broadcasting signal to its original state and outputs the signal. The decoder 115-3 separates audio, video, and broadcasting data signals from the demodulated broadcasting signal and individually decodes the separated signals through each corresponding decoder. The decoded audio signal is output through the speaker 140, and the decoded video signal is output through the display unit 145.

The digital broadcasting receiver 115 may have different configurations according to a broadcasting system. The digital broadcasting receiver may use a DMB system or a DVB system. The DMB system includes a ground wave DMB system and a satellite DMB system, and the DVB system includes a DVB-T system and a DVB-H system. Broadcasting data of the DMB and DVB systems may have a Moving Picture Experts Group 2-Transmission (MPEG2-TS) structure that uses packet streams in which each packet is configured with a packet header and a payload. The packet header includes packet identifier (PID) information for distinguishing broadcasting channels. Accordingly, the digital broadcasting receiver 115 may select a broadcasting channel by using the PID information. In a digital broadcasting receiver using a DMB or DVB-T system, a payload of each packet having an MPEG2-TS structure contains broadcasting signals (i.e. audio, video, and broadcasting data). In a digital broadcasting receiver using a DVB-H system, a payload of each packet having an MPEG2-TS structure contains information provider (IP) information and broadcasting signals. Accordingly, the demodulator 115-2 generates an MPEG2-TS signal by demodulating a service channel data signal, and the demodulated MPEG2-TS signal output by the demodulator 115-2 is transmitted to the decoder 115-3 in a compressed and encoded form.

Further, the decoder 115-3 may include a device for separating broadcasting data, an audio signal, and a video signal, and a plurality of decoders for individually decoding the signals. In a DMB or a DVB-T system, a demultiplexor may be used for separating the signals, and in a DVB-H system, an IP decapsulator may be used for separating the signals. In these cases, the demultiplexor or the IP decapsulator separates audio, video, and broadcasting data signals from the MPEG2-TS stream of the selected broadcasting channel output by the demodulator 115-2, and the decoder 115-3 may be configured with audio, video, and broadcasting data decoders. The broadcasting data may include broadcasting program information, various kinds of images related to the broadcasting program, and interactive information of the broadcasting program to enable participation by viewers receiving the broadcasting data. For example, the broadcasting data of the DMB system may include an electronic program guide (EPG), and the broadcasting data of the DVB-H system may include an electronic service guide (ESG).

The control unit 110 of the mobile terminal 100 may receive a control command for operating the digital broadcasting receiver 115 through the key input unit 150.

Figure 3:
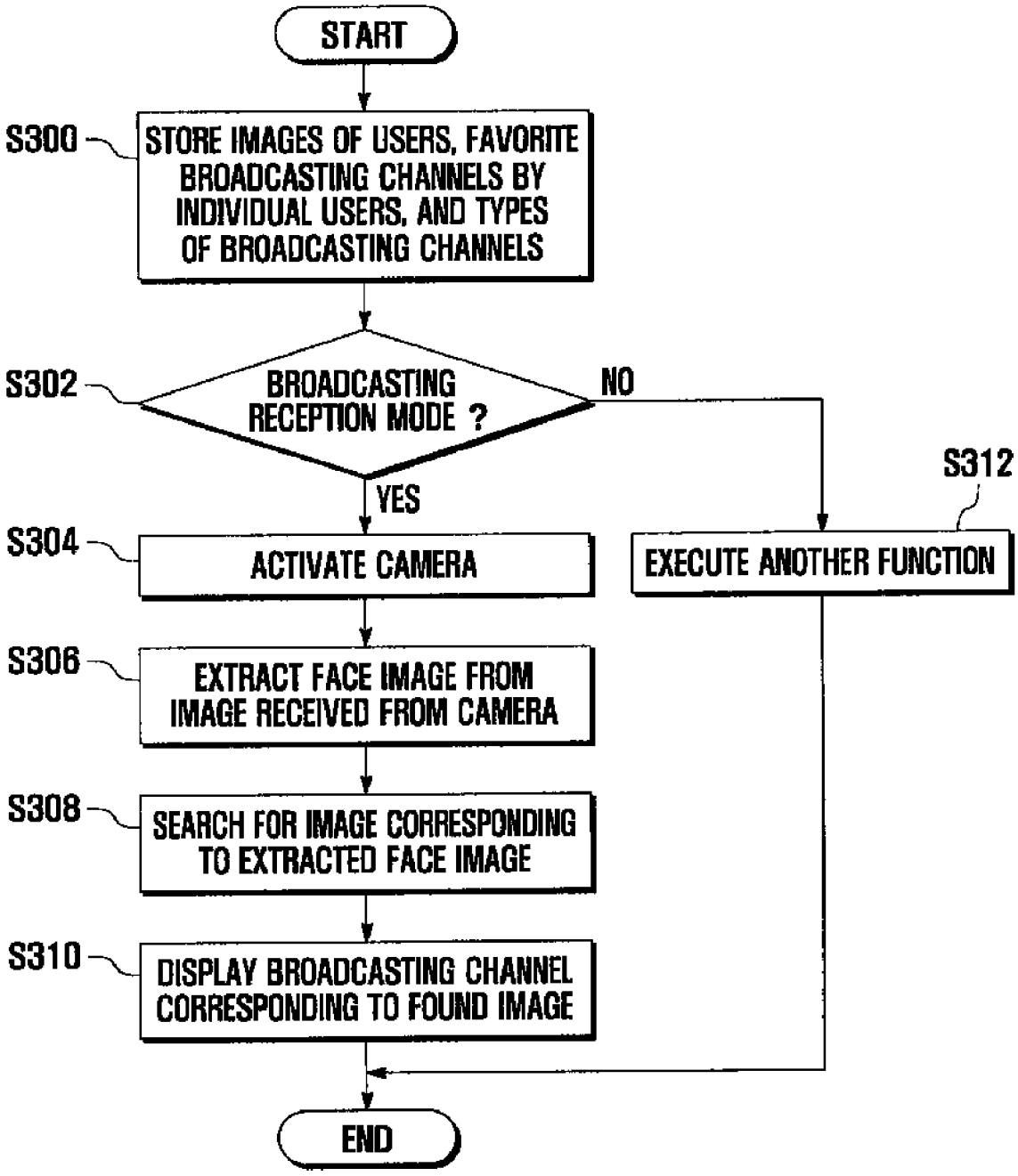
FIG. 3 is a flow chart showing a method of displaying a broadcasting channel in a mobile terminal according to another exemplary embodiment of the present invention.

FIG. 3 is a flow chart showing a method of displaying a broadcasting channel in a mobile terminal according to another exemplary embodiment of the present invention.

Referring to FIG. 3, the mobile terminal 100 first stores an image of each user and at least one favorite broadcasting channel of the corresponding user (S300). The mobile terminal 100 may also store a type of the broadcasting channel. Table 1 shows an example of data that may be stored in the mobile terminal 100.

TABLE 1

| User | Favorite broadcasting channel | Type of favorite broadcasting channel |
|---|---|---|
| Image of user A | Channel A | Sports |
| Image of user B | Channel B, Channel b | Entertainment |
| Image of user C | Channel C | Drama |

Referring to Table 1, user A prefers Channel A, which relates to sports programming. User B prefers Channel B and Channel b, which relate to entertainment programming. User C prefers Channel C, which relates to drama programming. When a user prefers more than one broadcasting channel such as for example, user B, priorities may be assigned to each channel.

The control unit 110 determines whether the mobile terminal 100 is currently in a broadcasting reception mode (S302). The mobile terminal 100 may enter the broadcasting reception mode by operation of the key input unit 150 or another device of the mobile terminal 100. If the mobile terminal 100 is not in the broadcasting reception mode, the control unit 110 performs a function corresponding to the mode (S312). On the other hand, if the mobile terminal 100 is in the broadcasting reception mode, the control unit 110 activates the camera 125 (S304).

The control unit 110 then extracts a facial image from an image received from the camera 125 (S306) and searches for an image identical or similar to the extracted facial image (S308). If an identical or similar image to the extracted facial image is found, the control unit 110 controls the digital broadcasting receiver 115 to connect to a favorite broadcasting channel corresponding to the extracted facial image (S310). On the other hand, if an identical or similar image is not found, the control unit 110 may alert the user that the user is unknown and allow the unknown user to set up a profile that includes information such as that shown above in Table 1.

As described above, the mobile terminal 100 may display a broadcasting channel set individually by users.

Exemplary embodiments of displaying a broadcasting channel by using a picture in picture (PIP) function in the mobile terminal 100 are described below.

In a first exemplary embodiment of the mobile terminal 100 that displays a broadcasting channel by using the PIP function, a favorite broadcasting channel and a type of the broadcasting channel may be stored corresponding to each user, as described above. Here, the mobile terminal 100 may display the favorite broadcasting channel in a main screen and broadcasting channels similar to the favorite broadcasting channel in a sub-screen sequentially in a predetermined time interval by scanning the broadcasting channels. Accordingly, a user may watch broadcasting channels having the same type as their favorite broadcasting channel in the sub-screen in real time. For example, referring to Table 1, if an image of user A is extracted from an image received from the camera 125, the mobile terminal 100 displays Channel A in the main screen and other sports-related channels excluding Channel A in the sub-screen sequentially in a predetermined time interval by scanning the sports-related channels. The number of broadcasting channels displayed in the sub-screen, both simultaneously and sequentially, may vary according to the number of favorite broadcasting channels set in the mobile terminal 100.

In a second exemplary embodiment of the mobile terminal 100 that displays a broadcasting channel using the PIP function, if more than one facial image is extracted from an image received from the camera 125, the mobile terminal 100 displays a broadcasting channel corresponding to a facial image having the highest priority in the main screen, and displays the broadcasting channel(s) corresponding to the facial image (s) having a lower priority in the sub screen. Table 2 shows an example data that may be stored in the mobile terminal 100.

TABLE 2

| User | Favorite broadcasting channel | Priority |
|---|---|---|
| Image of user A | Channel A | 1 |
| Image of user B | Channel B | 2 |
| Image of user C | Channel C | 3 |

Referring to Table 2, an image of user A has the highest priority and an image of user C has the lowest priority. If two facial images are extracted from an image input through the camera 125, the mobile terminal 100 displays a broadcasting channel corresponding to a facial image having the higher priority in the main screen and a broadcasting channel corresponding to the other facial image having a lower priority in the sub-screen. For example, if a facial image of user A and a facial image of user C are extracted from an image input through the camera 125, the mobile terminal 100 displays Channel A in the main screen and Channel C in the sub-screen.

If more than two facial images are extracted from the image input through the camera 125, the mobile terminal 100 displays a broadcasting channel corresponding to a facial image having the highest priority in the main screen. The mobile terminal 100 may then display broadcasting channels corresponding to facial images having a lower priority in the sub-screen sequentially in a predetermined time interval. Alternatively, each broadcasting channel corresponding to a facial image having a lower priority may be displayed in its own sub-screen.

For example, referring to Table 2, if facial images of user A, user B, and user C are extracted from the image input through the camera 125, Channel A, which corresponds to user A, is displayed in the main screen. Channel B, which corresponds to user B, and Channel C, which corresponds to user C, may be displayed in one sub screen sequentially in a predetermined time interval or in two different sub screens simultaneously.

In a third exemplary embodiment of the mobile terminal 100 that displays a broadcasting channel using the PIP function, if a new facial image is extracted from an image input through the camera 125 while displaying a broadcasting channel, the mobile terminal 100 displays a broadcasting channel corresponding to the newly extracted facial image.

For example, if a facial image of user B is newly extracted while displaying Channel A corresponding to user A, the mobile terminal 100 displays Channel B corresponding to user B in the sub-screen. Further, if a facial image of user A is newly extracted while displaying Channel B corresponding to user B in the main screen, the mobile terminal 100 switches the display of Channel B from the main screen to the sub-screen and displays Channel A in the main screen. If the facial image of user A is no longer extracted from the image input through the camera 125 while displaying Channel B in the sub-screen, the mobile terminal 100 switches Channel B to the main screen. Switching to the main screen may be performed after elapse of a predetermined time duration set by the user. Thus, when the camera 125 provides a video image, the mobile terminal 100 may monitor the facial images contained in the video signal and automatically adjust the display of the corresponding broadcast channels according to the preferences and priorities of the individual users.

As described above, exemplary embodiments of the present invention provide a method of changing a broadcasting channel in real time by using a face identification function, without a user's key operation, in the case that different favorite broadcasting channels are set individually by users. Further, if more than one user wants to watch broadcasting channels at the same time, each user may watch their favorite broadcasting channel on a main screen or on a sub-screen according to the priorities of the users.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method of displaying a broadcasting channel in a mobile terminal, comprising:

entering a broadcasting reception mode;

extracting a facial image from an image input through a camera;

searching for a corresponding image to the extracted facial image from at least one image stored in a memory unit; and displaying a broadcasting channel that corresponds to the corresponding image.

2. The method of claim 1, further comprising storing the at least one image and at least one broadcasting channel for each at least one image in the memory unit.

3. The method of claim 2, further comprising storing a type of the stored broadcasting channel in the memory unit before entering the broadcasting reception mode.

4. The method of claim 3, wherein displaying a broadcasting channel comprises:

displaying the broadcasting channel that corresponds to the corresponding image in a main screen; and displaying at least one other broadcasting channel having the same type as the broadcasting channel displayed in the main screen in a sub-screen.

5. The method of claim 2, wherein displaying a broadcasting channel comprises:

displaying a broadcasting channel having a higher priority in a main screen if more than one broadcasting channel is stored for the corresponding image; and displaying a broadcasting channel having a lower priority in a sub-screen.

6. The method of claim 1, wherein displaying a broadcasting channel comprises:

displaying a first broadcasting channel corresponding to a first facial image having a higher priority in a main screen if more than one facial image is extracted from the image input through the camera; and displaying a second broadcasting channel corresponding to a second facial image having a lower priority in a sub-screen.

7. The method of claim 1, further comprising displaying a broadcasting channel corresponding to a newly extracted facial image in a sub-screen when the newly extracted facial image is extracted from the image input through the camera while displaying the broadcasting channel that corresponds to the corresponding image.

8. A mobile terminal, comprising:

a camera;

a memory unit to store at least one image; and a control unit to extract, in a broadcasting reception mode, a facial image from an image input through the camera, to search for a corresponding image to the extracted facial image from at least one image stored in the memory unit, and to display a broadcasting channel that corresponds to the corresponding image.

9. A method of displaying a broadcasting channel in a mobile terminal, comprising:

entering a broadcasting reception mode;

receiving a signal from a camera, the signal comprising a first facial image;

detecting a first user of the mobile terminal by recognizing the first facial image;

displaying a first broadcasting channel that corresponds to the first user.

10. The method of claim 9, wherein the signal from the camera is a snapshot image taken when the mobile terminal enters the broadcasting reception mode.

11. The method of claim 9, wherein the signal from the camera is a video image taken while the mobile terminal remains in the broadcasting reception mode.

12. The method of claim 9, further comprising:

detecting a second user of the mobile terminal by recognizing a second facial image in the signal, the signal comprising the first facial image and the second facial image; and displaying a second broadcasting channel that corresponds to the second user, wherein the first broadcasting channel and the second broadcasting channel are simultaneously displayed.

13. The method of claim 12, further comprising:

determining a priority of the first user and a priority of the second user; and displaying the first broadcasting channel in a main screen and the second broadcasting channel in a sub-screen when the priority of the first user exceeds the priority of the second user.

14. The method of claim 13, further comprising:

displaying the second broadcasting channel in the main screen when the signal no longer comprises the first facial image.

15. The method of claim 12, further comprising:

detecting a third user of the mobile terminal by recognizing a third facial image in the signal, the signal comprising the first facial image, the second facial image, and the third facial image; and displaying a third broadcasting channel that corresponds to the third user, wherein the first broadcasting channel, the second broadcasting channel, and the third broadcasting channel are simultaneously displayed.

16. The method of claim 12, further comprising:

detecting a third user of the mobile terminal by recognizing a third facial image in the signal, the signal comprising the first facial image, the second facial image, and the third facial image; and displaying a third broadcasting channel that corresponds to the third user, wherein the first broadcasting channel is continuously displayed and the second broadcasting channel and the third broadcasting channel are alternately displayed with each other such that the first broadcasting channel is simultaneously displayed with only one of the second broadcasting channel and the third broadcasting channel.

17. The method of claim 9, further comprising displaying a second broadcasting channel that corresponds to the first user, wherein the first broadcasting channel and the second broadcasting channel are of the same programming type, and the first broadcasting channel is displayed on a main screen and the second broadcasting channel is displayed on a sub-screen.

* * * * *